US012544647B1

(12) United States Patent
Feltault et al.

(10) Patent No.: US 12,544,647 B1
(45) Date of Patent: Feb. 10, 2026

(54) GOALKEEPER GLOVE ASSEMBLY

(71) Applicants: Emily Feltault, Topsfield, MA (US); Christian Espitia-Betancourth, Woodbury, MN (US); Jasmin Francis, Brooklyn, NY (US); Nick Massina, Portland, OR (US)

(72) Inventors: Emily Feltault, Topsfield, MA (US); Christian Espitia-Betancourth, Woodbury, MN (US); Jasmin Francis, Brooklyn, NY (US); Nick Massina, Portland, OR (US)

( * ) Notice: Subject to any disclaimer, the term of this patent is extended or adjusted under 35 U.S.C. 154(b) by 0 days.

(21) Appl. No.: 18/814,655

(22) Filed: Aug. 26, 2024

Related U.S. Application Data

(60) Provisional application No. 63/534,375, filed on Aug. 24, 2023.

(51) Int. Cl.
*A63B 71/14* (2006.01)
*A41D 19/00* (2006.01)
*A41D 19/015* (2006.01)

(52) U.S. Cl.
CPC ..... *A63B 71/148* (2013.01); *A41D 19/0006* (2013.01); *A41D 19/01564* (2013.01); *A63B 2243/0025* (2013.01)

(58) Field of Classification Search
CPC ..... A41D 19/01523; A41D 19/0006; A41D 19/0048; A41D 19/01558; A41D 19/01564
See application file for complete search history.

(56) References Cited

U.S. PATENT DOCUMENTS 4,095,292 A * 6/1978 Klein ..... A41D 19/0006 2/164
4,197,592 A * 4/1980 Klein ..... A41D 19/0006 2/164

(Continued)

FOREIGN PATENT DOCUMENTS

ES 2551560 T3 11/2015

OTHER PUBLICATIONS

Soccer glove. Patent translation [online]. Google Patents [retrieved on Dec. 23, 2023]. Retrieved from the Internet: <URL:https://patents.google.com/patent/ES2551560T3/en?oq=ES2551560>.

*Primary Examiner* — Jameson D Collier
(74) *Attorney, Agent, or Firm* — Cramer Patent & Design, PLLC.; Aaron R. Cramer

(57) ABSTRACT

A goalkeeper glove assembly is provided to improve grip, protection, and comfort during soccer play. The assembly includes an outer glove with a palmar side, dorsal side, and wrist portion, along with a wrap and fastener that allow adjustable securing around the wrist. The outer glove features finger sleeves and a thumb sleeve, each incorporating grip patches near the fingertips for enhanced ball control. A reinforcement patch located on the palmar side adds cushioning and impact protection. An inner glove may be positioned within the outer glove and includes its own set of finger sleeves with integrated compression elements designed to apply support to the user's fingers. The inner and outer gloves can be permanently joined at the wrist portions to form a single, unified structure. This configuration enhances ease of use and alignment, helping to maintain consistent glove performance while reducing discomfort and slippage during activity.

1 Claim, 6 Drawing Sheets

(56) References Cited

U.S. PATENT DOCUMENTS 4,525,877 A * 7/1985 Chong ..... A41D 19/01576 2/163
4,545,841 A * 10/1985 Jackrel ..... A41D 19/0006 156/290
4,751,749 A * 6/1988 Cowhey ..... A41D 19/015 2/163
5,020,162 A * 6/1991 Kersten ..... A41D 19/0068 2/164
6,772,441 B2 8/2004 Lucas, Jr.
9,072,325 B2 * 7/2015 Ragan ..... A41D 19/015
2004/0088777 A1 5/2004 Hochmuth
2005/0054487 A1 3/2005 Rogers
2006/0206981 A1 * 9/2006 Morrow ..... A63B 71/143 2/161.1
2007/0022513 A1 2/2007 Avis et al.
2007/0124849 A1 * 6/2007 Williams ..... B32B 27/322 2/275
2009/0183294 A1 7/2009 Lucas, Jr.
2012/0017350 A1 1/2012 McCrane
2013/0000006 A1 * 1/2013 Norton ..... A41F 1/06 2/16
2014/0304886 A1 * 10/2014 Eugene ..... A63B 71/14 2/163
2015/0143607 A1 * 5/2015 Ramirez ..... A63B 71/146 2/161.3
2016/0366958 A1 * 12/2016 Hochmuth ..... B32B 5/245
2016/0375343 A1 * 12/2016 Woodhead ..... A63B 71/143 2/16
2017/0295868 A1 * 10/2017 Yahnite ..... A63B 71/148
2017/0361199 A1 12/2017 Hussain
2019/0176014 A1 * 6/2019 Chen ..... A41D 19/01523
2021/0077891 A1 * 3/2021 Pechtold ..... A63B 71/148
2021/0145093 A1 * 5/2021 Blunt ..... A41D 19/01523
2022/0395742 A1 12/2022 Rodriguez-Garcia et al.
2023/0008444 A1 * 1/2023 Boehme ..... A41D 19/01564
2023/0390629 A1 * 12/2023 Boehme ..... A63B 71/148

* cited by examiner

GOALKEEPER GLOVE ASSEMBLY

RELATED APPLICATIONS

The present device was first described in and is a continuation of U.S. Provisional Application No. 63/534,375, filed Aug. 24, 2023, the entire disclosures of which are incorporated herein by reference.

FIELD OF THE DEVICE

The present device relates to a goalkeeper glove assembly that includes an outer glove and an inner glove that when worn together provides enhanced dexterity, comfort, and protection.

BACKGROUND OF THE DEVICE

In many sports where there is a ball or other similar projection being used, an aim is to place the ball inside a goal-type structure. Particularly, soccer is played with the feet and head and usage of the hands and arms are forbidden. The aim of soccer is to have a team of individuals compete against another team of individuals to place the ball in the opposing goal more times than the other team during a pre-determined period of time. Such as goal is usually a net in the field and is typically guarded by a specialized player on the team, known as a goalkeeper.

The job of the goalkeeper is to keep the ball from entering their goal that they are guarding. If it does it results in a score for the opposing team. The goalkeeper is permitted the use of their entire body to prevent the ball from entering the goal, particularly within a specialized area of the field right in front of the goal. Often times, the ball is struck with a lot of force and speed and as such, the goalkeeper may use equipment, within the framework of the sport's rules, in order to prevent a goal being scored. Such equipment may be the use of gloves to aid in protecting the hands of the goalkeeper while also providing enhanced gripping and dexterity. Also, comfort is concern. Many gloves exist, but none on the market provide such a combination of necessary features that aid the goalkeeper in performing their duties without compromising functionality or performance. The use of the goalkeeper glove assembly fulfills this need.

SUMMARY OF THE DEVICE

Embodiments of the present disclosure may include a goalkeeper glove assembly including an outer glove having an interior configured to receive a hand of a user, the outer. Embodiments may also include glove further including a palmar side. Embodiments may also include a dorsal side. Embodiments may also include a wrist portion.

Embodiments may also include a plurality of finger sleeves including a first finger sleeve. Embodiments may also include a second finger sleeve. Embodiments may also include a third finger sleeve. Embodiments may also include a fourth finger sleeve. Embodiments may also include a thumb sleeve. Embodiments may also include a wrap attached to the outer glove and configured to secure the outer glove to the hand of the user. Embodiments may also include a reinforcement located on the palmar side, the reinforcement providing additional cushioning and protection.

In some embodiments, the goalkeeper glove assembly may include a fastener attached to the wrap, the fastener configured for adjusting the tightness of. In some embodiments, the outer glove on the hand of the user. Embodiments may also include each of the first finger sleeve, second finger sleeve, third finger sleeve, fourth finger sleeve, and thumb sleeve includes at least one grip located adjacent to a tip of the respective sleeve.

In some embodiments, the goalkeeper glove assembly may include an inner glove configured to be worn beneath the outer glove, the inner glove. Embodiments may also include an interior configured to receive the hand of the user. Embodiments may also include a palmar side.

Embodiments may also include a dorsal side. Embodiments may also include a wrist portion. Embodiments may also include a plurality of finger sleeves including a first finger sleeve. Embodiments may also include a second finger sleeve. Embodiments may also include a third finger sleeve.

Embodiments may also include a fourth finger sleeve. Embodiments may also include a thumb sleeve. Embodiments may also include a plurality of compressions located on each of the first finger sleeve. Embodiments may also include second finger sleeve, third finger sleeve, fourth finger sleeve, and thumb sleeve of the inner glove, the compressions providing a protective compression force.

In some embodiments, the inner glove may include a first padding located subjacent to the thumb compression. Embodiments may also include a second padding located subjacent to the first finger compression, each padding. Embodiments may also include configured to provide additional cushioning and protection.

In some embodiments, the inner glove and the outer glove may be permanently affixed to each other along their respective wrist portions, forming a single unified glove assembly. In some embodiments, the inner glove and the outer glove may be seamlessly bonded, ensuring consistent alignment and preventing misalignment or slippage between the inner and outer gloves during use.

In some embodiments, the palmar side of the outer glove may include an enhanced gripping material affixed to a base material of the outer glove. In some embodiments, the grips on the finger sleeves and thumb sleeve may be laser etchings or bonded patches of the enhanced gripping material. In some embodiments, the wrap has a length sufficient to encircle the outer glove a plurality of times.

BRIEF DESCRIPTION OF THE DRAWINGS

The advantages and features of the present device will become better understood with reference to the following more detailed description and claims taken in conjunction with the accompanying drawings, in which like elements are identified with like symbols, and in which:

DESCRIPTIVE KEY

Figure 1:
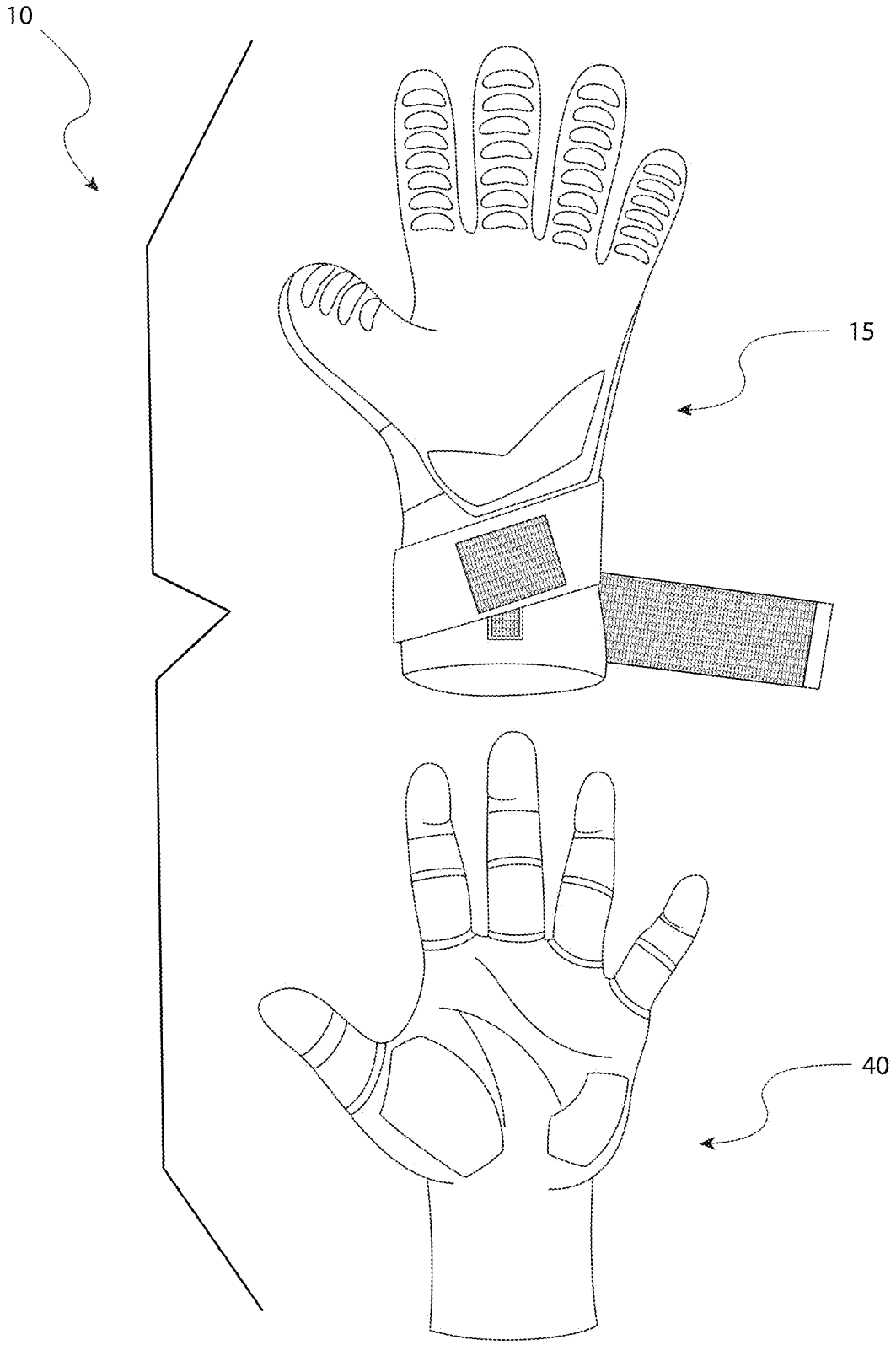
FIG. 1 is a front view of the goalkeeper glove assembly 10, including an outer glove 15 and an inner glove 40 prior to be worn, according to a preferred embodiment of the present device.

10 goalkeeper glove assembly
15 outer glove

16 outer glove interior
17*a* outer glove palmar side
17*b* outer glove dorsal side
18*a* outer glove first finger sleeve
18*b* outer glove second finger sleeve
18*c* outer glove third finger sleeve
18*d* outer glove fourth finger sleeve
18*e* outer glove thumb sleeve
19 outer glove wrist portion
20 wrap
22 fastener
30 reinforcement
31*a* first padding
31*b* second padding
33*a* first finger grip
33*b* second finger grip
33*c* third finger grip
33*d* fourth finger grip
33*e* thumb grip
40 inner glove
41 inner glove interior
42*a* inner glove palmar side
42*b* inner glove dorsal side
43*a* inner glove first finger sleeve
43*b* inner glove second finger sleeve
43*c* inner glove third finger sleeve
43*d* inner glove fourth finger sleeve
43*e* inner glove thumb sleeve
44*a* first finger compression
44*b* second finger compression
44*c* third finger compression
44*d* fourth finger compression
44*e* thumb compression
45 inner glove wrist portion
50 user
55 soccer ball 1. Description of the Device The best mode for carrying out the device is presented in terms of its preferred embodiment, herein depicted within FIGS. 1 through 5 with an intended method of wearing and use depicted in FIG. 6. However, the device is not limited to the described embodiment, and a person skilled in the art will appreciate that many other embodiments of the device are possible without deviating from the basic concept of the device and that any such work around will also fall under scope of this device. It is envisioned that other styles and configurations of the present device can be easily incorporated into the teachings of the present device, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

Figure 6:
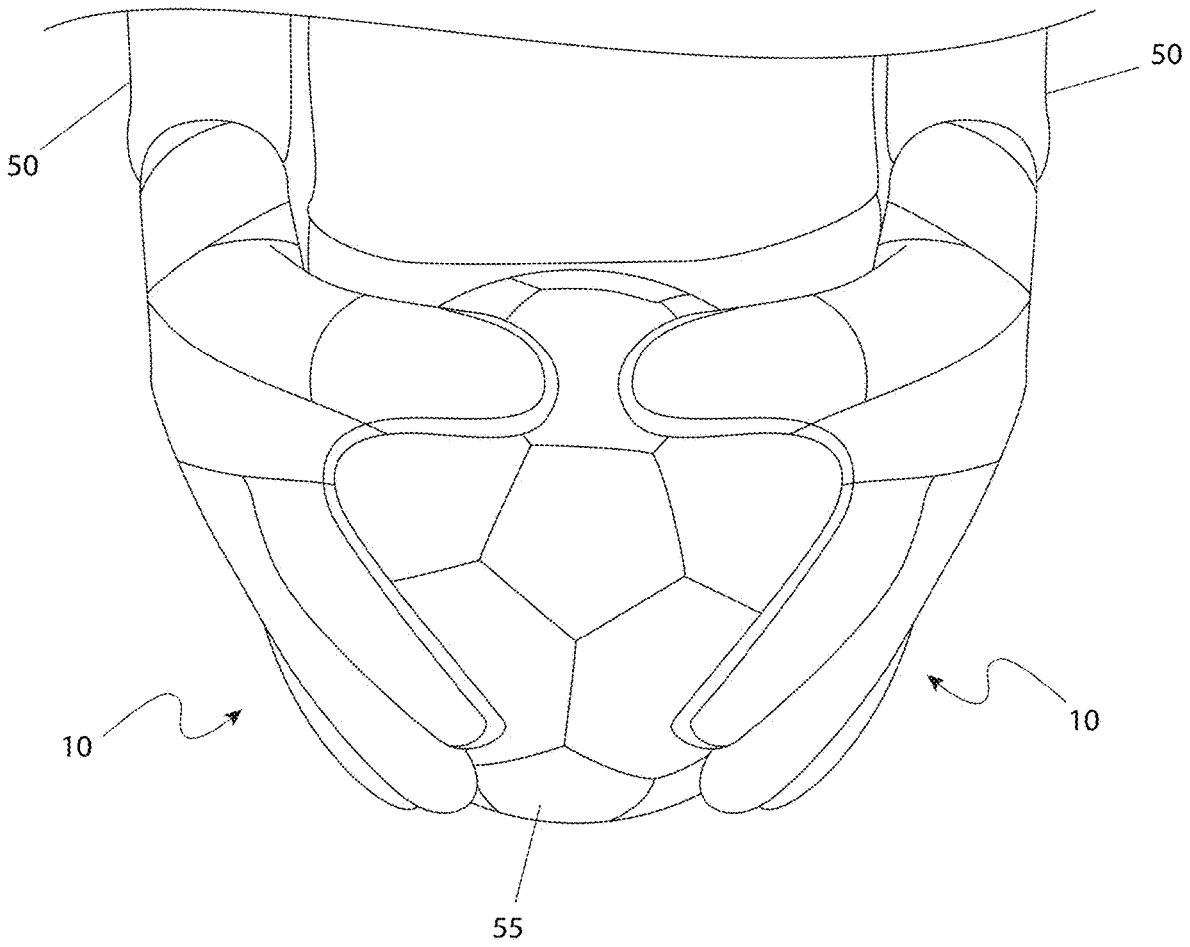

Referring to FIGS. 1 and 6, the goalkeeper glove assembly 10 generally comprises two (2) disparate elements, an inner glove 40 capable of being worn on either hand of a user 50, and an outer glove 15 capable of being worn over the inner glove 40 and also capable of being worn on either hand of the user 50. The outer glove 15 is capable of retaining a gripping and a cushioning effect when catching or deflecting a soccer ball 55. The inner glove 40 provides enhanced dexterity and comfort to the user 50, while also providing compression action to the fingers of the user 50.

Figure 2:
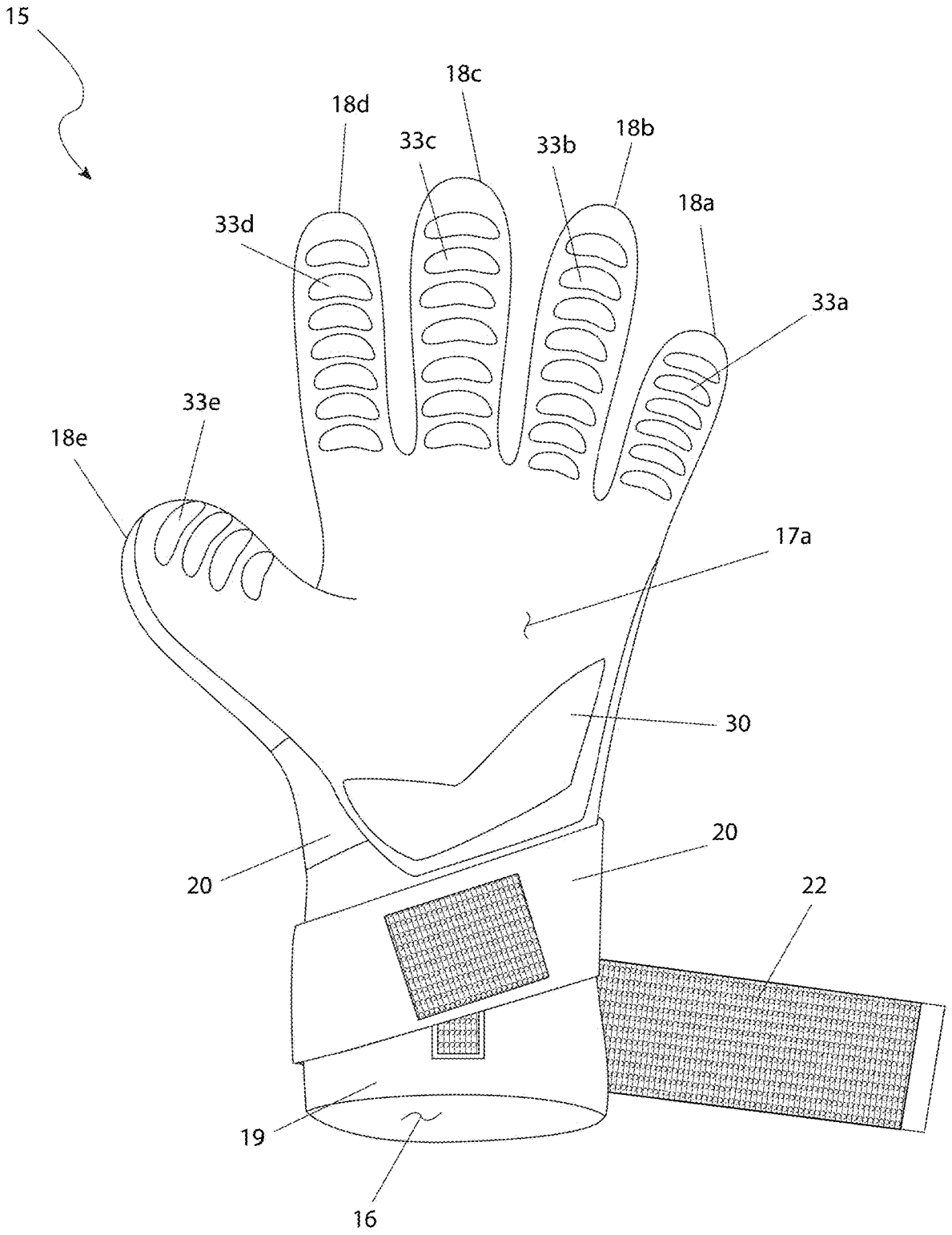
FIG. 2 is a front view of the outer glove 15, according to a preferred embodiment of the present device.
Figure 3:
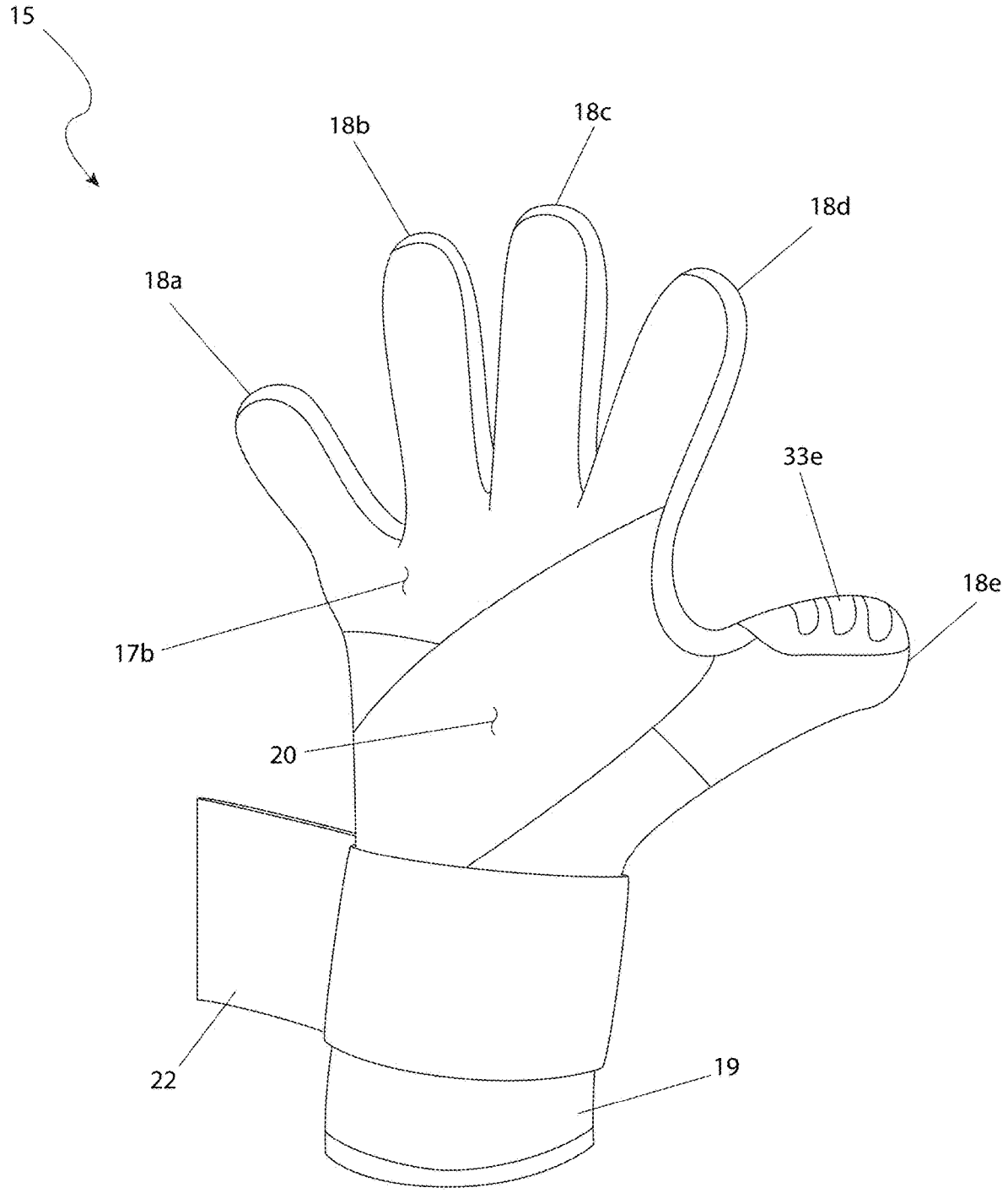
FIG. 3 is a rear view of the outer glove 15, according to a preferred embodiment of the present device.

Referring more closely to FIGS. 2 and 3, it is shown that an outer glove 15 comprises an outer glove wrist portion 19 with an open end. The outer glove 15 further includes an outer glove palmar side 17*a* and an outer glove dorsal side 17*b*, each an extension of and integral with the outer glove wrist portion 19. The outer glove palmar side 17*a* may further have an enhanced gripping material, such as latex, attached to the base material. A wrap 20 is used to snugly removably affix the outer glove 15 to the user 50 when worn (either independently or in combination over a already currently worn inner glove 40). Such a wrap 20 may be similar in size and configuration as a boxing glove wrap. The wrap 20 has a first end affixed to the outer glove dorsal side 17*b*, located adjacent to the outer glove fourth finger sleeve 18*d* and outer glove thumb sleeve 18*e*. The wrap 20 further has a fastener 22 (e.g., hook-and-loop-type) to secure the desired tightness of the outer glove 15. The wrap 20 may have a length enabling it to encircle the outer glove 15 a plurality of times. A patch of reinforcement 30 is located on the outer glove palmar side 17*a* adjacent to the wrap 20 and is configured to provide additional cushioning and protection to the user 50. The patch of reinforcement 30 is preferably located on the enhanced gripping material. Any or all of the outer glove 15 material may be knitted for extra durability, comfort, and lightweight properties.

An outer glove first finger sleeve 18*a* (i.e., a "pinky" sleeve), an outer glove second finger sleeve 18*b* (i.e., a "ring" sleeve), an outer glove third finger sleeve 18*c* (i.e., a "middle" sleeve), an outer glove fourth finger sleeve 18*d* (i.e., a "pointer" sleeve), and an outer glove thumb sleeve 18*e*, are each an extension of and integral with the outer glove palmar side 17*a* and outer glove dorsal side 17*b* and each terminates in a closed end. Defined within the outer glove 15 is an outer glove interior 16, capable of being worn by and conforming to the wrist, hand, and fingers of a user 50. At least one (1) first finger grip 33*a* may be located on the outer glove first finger sleeve 18*a* adjacent the tip thereof. At least one (1) second finger grip 33*b* may be located on the outer glove second finger sleeve 18*b* adjacent the tip thereof. At least one (1) third finger grip 33*c* may be located on the outer glove third finger sleeve 18*c* adjacent the tip thereof. At least one (1) fourth finger grip 33*d* may be located on the outer glove fourth finger sleeve 18*d* adjacent the tip thereof. At least one (1) thumb grip 33*e* may be located on the outer glove thumb sleeve 18*e* adjacent the tip thereof. The finger and thumb grips 33*a*, 33*b*, 33*c*, 33*d*, 33*e* may be located above the outer glove palmar side 17*a*. The finger and thumb grips 33*a*, 33*b*, 33*c*, 33*d*, 33*e* may be laser etchings of the latex of the gripping material of the outer glove palmar side 17*a*, or they may be bonded thereto. The finger and thumb grips 33*a*, 33*b*, 33*c*, 33*d*, 33*e* may provide enhanced durability and gripping functions. In the exemplary embodiment, the finger and thumb grips 33*a*, 33*b*, 33*c*, 33*d*, 33*e* each comprise discontinuous patches of gripping material.

Figure 4:
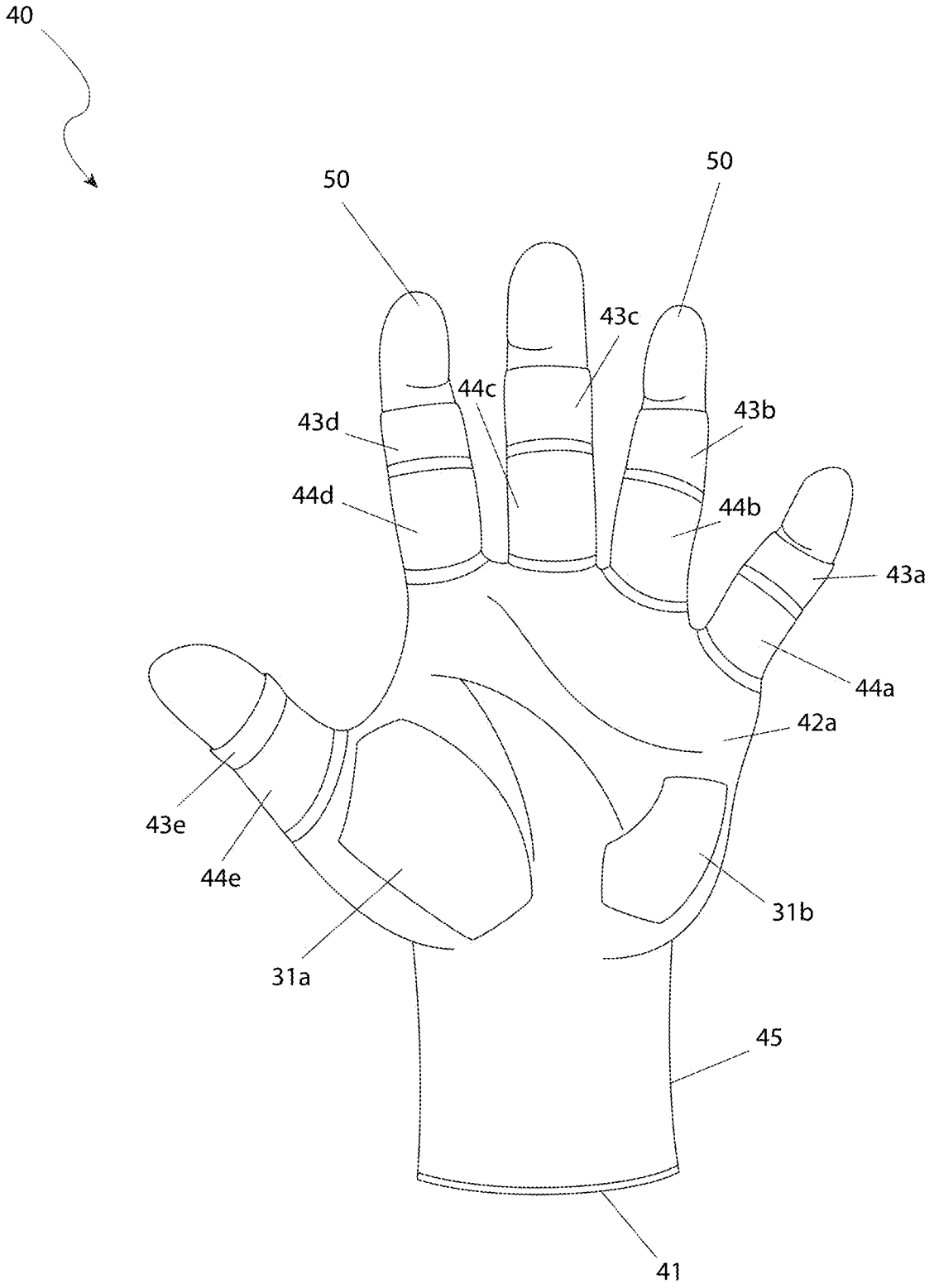
FIG. 4 is a front view of the inner glove 40, according to a preferred embodiment of the present device.
Figure 5:
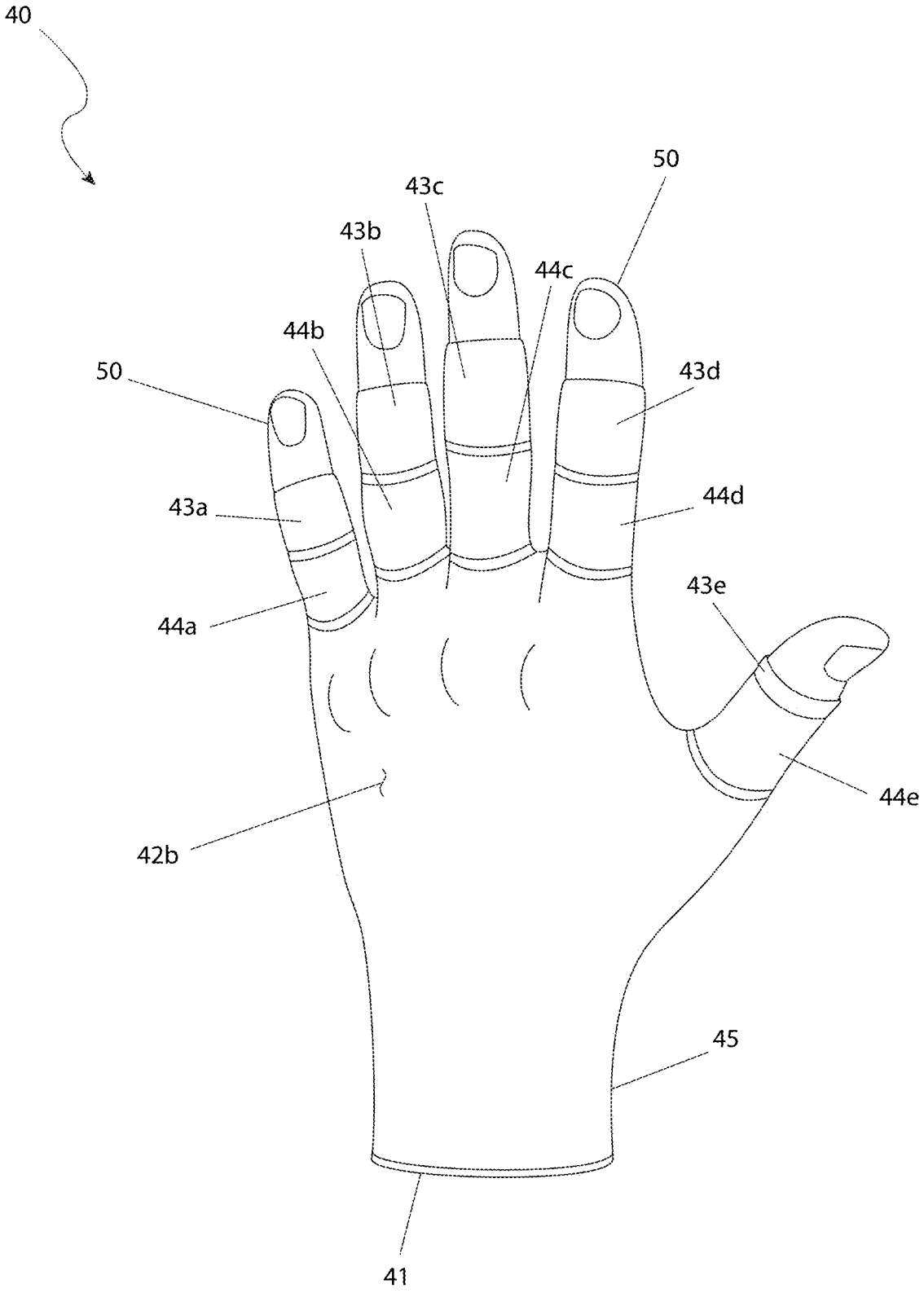
FIG. 5 is a rear view of the inner glove 40, according to a preferred embodiment of the present device; and, FIG. 6 is an environmental view of the goalkeeper glove assembly 10 being worn by a user 50, according to a preferred embodiment of the present device.

Referring now to FIGS. 4 and 5, the inner glove 40 comprises an inner glove wrist portion 45 with an open end. The inner glove 40 further includes an inner glove palmar side 42*a* and an inner glove dorsal side 42*b*, each an extension of and integral with the inner glove wrist portion 45. The inner glove palmar side 42*a* may further have a patch of first padding 31*a* located subjacent to the thumb compression 44*e* and a patch of second padding 31*b* located subjacent to the first finger compression 44*a* and is configured to provide additional cushioning and protection to the user 50 at commonly used points. The inner glove 40 may comprise material suitable for flexibility, light weight properties, and to minimize frictional contact.

An inner glove first finger sleeve 43*a*, an inner glove second finger sleeve 43*b*, an inner glove third finger sleeve

43*c*, an inner glove fourth finger sleeve 43*d*, and an inner glove thumb sleeve 43*e*, each an extension of and integral with the inner glove palmar side 42*a* and inner glove dorsal side 42*b* and each terminating in an open end to expose the fingers of the user 50 when worn. Defined within the inner glove 40 is an inner glove interior 41 capable of being worn by the wrist, hand, and fingers of a user 50. A first finger compression 44*a* may be located on the inner glove first finger sleeve 43*a* adjacent the open end thereof. A second finger compression 44*b* may be located on the inner glove second finger sleeve 43*b* adjacent the open end thereof. A third finger compression 44*c* may be located on the inner glove third finger sleeve 43*c* adjacent the open end thereof. A fourth finger compression 44*d* may be located on the inner glove fourth finger sleeve 43*d* adjacent the open end thereof. A thumb compression 44*e* may be located on the inner glove thumb sleeve 43*e* adjacent the open end thereof. When the inner glove 40 is worn, the finger and thumb compressions 44*a*, 44*b*, 44*c*, 44*d*, 44*e* may be located above any or all of the interphalangeal joints of the fingers to provide a protective compression force thereupon. The finger and thumb compressions 44*a*, 44*b*, 44*c*, 44*d*, 44*e* may each encircle the respective finger sleeve 43*a*, 43*b*, 43*c*, 43*d*, 43*e* and may be attached, affixed, bonded, or integral therewith. The finger and thumb compressions 44*a*, 44*b*, 44*c*, 44*d*, 44*e* comprise material that is elastic and provides a compression force to the parts of the user 50 (e.g., fingers) that they contact.

In an alternate embodiment, the goalkeeper glove assembly 10 may consist of an integrated design where the inner glove 40 and outer glove 15 are permanently affixed to each other along the inner glove wrist portion 45 and the outer glove wrist portion 19. In this configuration, the inner glove 40 is seamlessly bonded within the outer glove 15, creating a single unified glove assembly that simplifies donning and doffing for the user 50. The inner glove 40 retains its compression features through finger compressions 44*a*, 44*b*, 44*c*, 44*d*, 44*e* and provides cushioning through strategic padding 31*a*, 31*b*, while the outer glove 15 enhances grip and protection with the finger grips 33*a*, 33*b*, 33*c*, 33*d*, 33*e* and reinforcement 30. This embodiment ensures that the enhanced dexterity and comfort offered by the inner glove 40 are consistently aligned with the protective and gripping functions of the outer glove 15, thereby offering a streamlined solution for goalkeepers seeking both performance and ease of use in a single product. The integrated glove assembly would maintain the individual characteristics and benefits of each glove component, while eliminating the need for separate assembly or adjustment, thus enhancing the overall user experience and reducing the likelihood of misalignment or slippage between the inner and outer gloves during play.

The foregoing descriptions of specific embodiments of the present device have been presented for purposes of illustration and description. They are not intended to be exhaustive or to limit the device to the precise forms disclosed, and obviously many modifications and variations are possible in light of the above teaching. The embodiments were chosen and described in order to best explain the principles of the device and its practical application, to thereby enable others skilled in the art to best utilize the device and various embodiments with various modifications as are suited to the particular use contemplated.

What is claimed is:

1. A goalkeeper glove assembly comprising:

an outer glove having:

an outer glove palmar side;

an outer glove dorsal side; and, an outer glove wrist portion, wherein the outer glove palmar side, the outer glove dorsal side and the outer glove wrist portion together define an outer glove interior;

a plurality of outer glove finger sleeves including:

a first finger sleeve;

a second finger sleeve;

a third finger sleeve;

a fourth finger sleeve; and, a thumb sleeve;

wherein each outer glove finger sleeve is integral with the outer glove palmar side and the outer glove dorsal side and terminates in a closed end;

a wrap having:

a first end affixed to the outer glove dorsal side at a location adjacent both the fourth finger sleeve and the thumb sleeve; and, a free end extending from the outer glove, the wrap having a length enabling the wrap to encircle the outer glove a plurality of times;

a fastener disposed on the wrap and configured to secure the wrap at a user-adjustable tightness;

a reinforcement patch located on the outer glove palmar side adjacent to the wrap and positioned on an enhanced gripping material of the outer glove palmar side, the reinforcement patch being configured to provide additional cushioning and protection;

a plurality of grip patches on the outer glove palmar side, each of the plurality of grip patches being disposed adjacent to a respective fingertip of the first, second, third, and fourth finger sleeves and the thumb sleeve, each of the plurality of grip patches comprising a discontinuous patch of enhanced gripping material that is one of:

a laser etching of latex of the enhanced gripping material, or a bonded patch of the enhanced gripping material affixed to the outer glove palmar side; and, an inner glove disposed within the outer glove interior and having:

an inner glove palmar side;

an inner glove dorsal side; and, an inner glove wrist portion with an open end; and, a plurality of inner glove finger sleeves including:

a first inner finger sleeve;

a second inner finger sleeve;

a third inner finger sleeve;

a fourth inner finger sleeve; and, a thumb inner sleeve;

wherein each inner glove finger sleeve terminates at a respective open end to expose a respective fingertip of a user to a respective one of the plurality of outer glove finger sleeves' closed ends, when worn; and, a plurality of finger compressions comprising:

a first finger compression;

a second finger compression;

a third finger compression;

a fourth finger compression; and, a thumb compression; and, each of the plurality of finger compressions encircling a respective one of the inner glove finger sleeves adjacent the respective sleeve's open end, each of the plurality of finger compressions comprising elastic material and being positionable over an interphalangeal joint to apply a protective compression force when worn;

first padding located on the inner glove palmar side subjacent to the thumb compression and second padding located on the inner glove palmar side subjacent to the first finger compression, the padding configured to provide additional cushioning and protection at points adapted to be commonly used; and, wherein the inner glove wrist portion and the outer glove wrist portion are permanently affixed to each other to form a unified glove assembly that is configured to simplify donning and doffing and maintain alignment of the inner glove and the outer glove during play.

* * * * *